United States Patent [19]

Webb et al.

[11] Patent Number: 4,641,476

[45] Date of Patent: Feb. 10, 1987

[54] ROOF EDGE CONSTRUCTION

[75] Inventors: Russell Webb, Woodfin; John B. Hickman, Asheville, both of N.C.

[73] Assignee: W. P. Hickman Company, Asheville, N.C.

[21] Appl. No.: 733,641

[22] Filed: May 13, 1985

[51] Int. Cl.[4] ..... E04D 1/36

[52] U.S. Cl. ..... 52/60; 52/94

[58] Field of Search ..... 52/60, 94, 95, 96, 97, 52/300, 573, 466, 469, 717, 718

[56] References Cited

U.S. PATENT DOCUMENTS

| | | |
|---|---|---|
| Re. 26,056 | 7/1966 | Hickman . |
| Re. 27,761 | 9/1973 | Attaway . |
| 164,602 | 6/1875 | Shepard . |
| 674,379 | 5/1901 | Hard . |
| 1,299,425 | 4/1919 | Carpenter . |
| 1,337,840 | 4/1920 | Hawley . |
| 1,740,753 | 12/1929 | Vallas . |
| 1,782,246 | 11/1930 | Schneider . |
| 2,136,122 | 11/1938 | Almdale . |
| 2,160,758 | 5/1939 | Schurman . |
| 2,219,992 | 10/1940 | Hanson . |
| 2,250,548 | 7/1941 | Ness . |
| 2,554,779 | 5/1951 | Goodwin . |
| 2,734,602 | 2/1956 | Dawson . |
| 2,755,484 | 7/1956 | Hotz . |
| 2,793,403 | 5/1957 | Livingston . |
| 2,855,776 | 10/1958 | Trostle . |
| 2,857,861 | 10/1958 | Trostle . |
| 2,920,477 | 1/1960 | Shaw . |
| 3,012,376 | 12/1961 | Reddy et al. . |
| 3,024,573 | 3/1962 | McKinley . |
| 3,090,161 | 5/1963 | Edwards . |
| 3,237,352 | 3/1966 | Edwards . |
| 3,389,515 | 6/1968 | Hellebrand . |
| 3,405,485 | 10/1968 | Edwards . |
| 3,415,020 | 12/1968 | Windle . |
| 3,444,658 | 5/1969 | Gobel . |
| 3,447,273 | 6/1969 | Thom . |
| 3,488,902 | 1/1970 | Gobel . |
| 3,503,162 | 3/1970 | Ward . |
| 3,529,653 | 9/1970 | Fey, Jr. . |
| 3,533,201 | 10/1970 | Tyler . |

List Continued on next page.

FOREIGN PATENT DOCUMENTS

| | | |
|---|---|---|
| 603078 | 8/1960 | Canada . |
| 1509147 | 11/1969 | Fed. Rep. of Germany . |
| 1918761 | 10/1970 | Fed. Rep. of Germany . |
| 1659340 | 1/1971 | Fed. Rep. of Germany . |
| 1933004 | 1/1971 | Fed. Rep. of Germany . |
| 2060292 | 6/1972 | Fed. Rep. of Germany . |
| 2118981 | 10/1972 | Fed. Rep. of Germany . |
| 2234975 | 2/1974 | Fed. Rep. of Germany . |
| 2316266 | 10/1974 | Fed. Rep. of Germany . |
| 2335223 | 1/1975 | Fed. Rep. of Germany . |
| 1128360 | 8/1956 | France . |
| 7610357A | 4/1977 | Netherlands . |
| 7432 | of 1911 | United Kingdom . |
| 1024071 | 3/1966 | United Kingdom . |
| 1104027 | 2/1968 | United Kingdom . |
| 1180965 | 2/1970 | United Kingdom . |
| 1203344 | 8/1970 | United Kingdom . |
| 1347974 | 2/1974 | United Kingdom . |
| 2084628 | 4/1982 | United Kingdom . |

*Primary Examiner*—William F. Pate, III

*Assistant Examiner*—Creighton Smith

*Attorney, Agent, or Firm*—Harness, Dickey & Pierce

[57] ABSTRACT

An assembly is disclosed for forming a raised roof edge on a building structure that preferably has a generally horizontal roof and a generally vertical outer face. The assembly includes a dam member for forming a water dam or gravel stop, a fascia member, and a separate spring clip member interposed therebetween for resiliently biasing the fascia member into a relatively tight and rattle-free interlocking installation on the dam member. Preferably, a roofing material is interposed between the spring clip member and the dam member and is frictionally secured and anchored therebetween as a result of the resilient biasing forces of the resilient spring clip member. The roof edge assembly thereby provides an improved water dam or gravel stop structure that securely retains the roofing material on the roof of the building structure.

36 Claims, 8 Drawing Figures

U.S. PATENT DOCUMENTS

| | | | |
|---|---|---|---|
| 3,571,992 | 3/1971 | Comiskey . | |
| 3,608,255 | 9/1971 | Chomes . | |
| 3,624,973 | 12/1971 | Attaway . | |
| 3,668,811 | 6/1972 | Pollard . | |
| 3,680,269 | 8/1972 | Fischer, Jr. et al. | 52/60 X |
| 3,696,575 | 10/1972 | Armstrong . | |
| 3,712,002 | 1/1973 | Hallock et al. . | |
| 3,719,010 | 3/1973 | Hickman . | |
| 3,731,439 | 5/1973 | Hickman . | |
| 3,738,068 | 6/1973 | Attaway | 52/60 |
| 3,742,668 | 7/1973 | Oliver . | |
| 3,802,140 | 4/1974 | Hickman . | |
| 3,812,634 | 5/1974 | Resech . | |
| 4,037,372 | 7/1977 | Patry . | |
| 4,067,152 | 1/1978 | Wolma | 52/60 |
| 4,071,987 | 2/1978 | Hickman . | |
| 4,071,987 | 7/1984 | Hickman . | |
| 4,132,390 | 1/1979 | Pfarr, Jr. . | |
| 4,155,203 | 5/1979 | Wolma | 52/60 |
| 4,231,141 | 11/1980 | Derrick et al. . | |
| 4,241,549 | 12/1980 | Hall, III et al. | 52/60 |
| 4,404,777 | 9/1983 | Lolley et al. | 52/60 |
| 4,419,850 | 12/1983 | Butzen . | |
| 4,439,956 | 4/1984 | House | 52/60 |
| 4,472,913 | 9/1984 | Hickman . | |
| 4,483,112 | 11/1984 | Rueblinger . | |
| 4,488,384 | 12/1984 | Hickman . | |
| 4,549,376 | 10/1985 | Hickman | 52/60 X |

OTHER PUBLICATIONS

Fascias, Inc., sales catalog entitled "Master-Edge Extruded Aluminum Fascia", 1 page.

Braas & Co. GmbH brochure entitled "PVC Flat-roof Systems", (date unknown), 10 pages.

Braas Systems, Inc. brochure No. 1004 NA entitled "Purpose-made Accessories for Braas Flat Roofs", dated 1/81 and 7/79, 10 pages.

Pomar Building Products, Inc., sales sheet regarding "Hilite Fascia A".

W. P. Hickman Co., "Hickman Aluminum Construction Products", 1980—16 pages.

Alcoa Catalog, page entitled "Type JJ" Gravel Stop.

Brochure, "The Snap-on Roof is Here!", published by Carlisle SynTec Systems, 4 pages.

MM Systems Corporation catalog page entitled "Drip--Proof Fascia and Cant Dam Systems, F-Series".

MM Systems Corporation brochure entitled "Fascia Systems", 16 pages.

ROOF EDGE CONSTRUCTION

BACKGROUND AND SUMMARY OF THE INVENTION

The invention relates generally to building structures and more particularly to raised roof edge constructions for such building structures.

Various raised roof edge assemblies, gravel stop assemblies, water dams, and the like, have been provided for purposes of anchoring a sheet-like roofing membrane, retaining gravel ballast or other roofing materials for controlling water drainage, and for supporting a fascia member at the edge of the roof of a building structure. Examples of such previously-provided assemblies are disclosed in U.S. Pat. Nos. 3,719,010; Re. 26,056; 4,071,987; 4,472,913; and 4,488,384, the references cited therein, and in copending U.S. application Ser. No. 309,062, filed Oct. 6, 1981, now U.S. Pat. No. 4,549,376, entitled ROOF EDGE CONSTRUCTION. The disclosures of these patents and this application are hereby incorporated herein by reference.

The inventions disclosed in the above-referenced patents and application represent great strides over previous roof edge constructions in terms of simplicity, cost effectiveness, ease of installation, and effectiveness in anchoring roofing membranes. It has been found, however, in many instances that it is desirable to even further increase the anchoring engagement of a roofing material at the edge of a building structure. Therefore, the present invention seeks to provide such further increased anchoring and holding power of the roofing material in a spring-action or snap-on type fascia mounting and supporting assembly that also forms a raised roof edge or gravel stop at the outer edge of the roof structure. The invention further addresses itself to increasing both the simplicity of the components involved in the assembly and the ease of their installation.

According to the present invention, an assembly is provided for forming a raised roof edge on a building structure that has a generally vertical outer face. The assembly according to the present invention includes a dam member with a vertical dam portion having an inwardly directed face for confronting the outer face of the building structure. The vertical dam portion includes an upper dam portion and a lower dam portion, with attachment means for attaching the vertical dam portion to the outer face of the building structure with the upper dam portion protruding upwardly above the roof. A fascia member is securely installable on the dam member and preferably includes a generally concave upper portion for receiving the upper dam portion therein, as well as a lower channel portion for receiving the lower dam edge portion therein, when the fascia member is securingly installed on the dam member.

A spring clip member is provided in the above-described roof edge assembly for interposition between the fascia member and the dam member when the fascia member is securely installed thereon. Preferably the spring clip member has a generally vertical spring clip portion that is positionable in a generally confronting relationship with the vertical dam portion, a first sloping portion generally at the top of the vertical spring clip portion extending generally downwardly and inwardly relative to the vertical dam portion, and a lower spring clip edge portion on the first sloping portion. A second sloping portion of the spring clip extends in a generally upward direction, generally from the lower spring clip edge portion. The spring clip in the preferred embodiments of the present invention is composed of a resilient and deflectable spring material so that at least the second sloping portion of the spring clip is resiliently and pivotably deflectable in a generally downward and outward direction toward the first sloping portion when the fascia member is securely installed on the dam member with the spring clip member interposed therebetween.

Preferably, according to the present invention, a sheet-like roofing material overlappingly engages at least a portion of the dam member and is grippingly interposed between the dam member and the spring clip member. The above-mentioned resilient deflection of the second sloping portion of the spring clip member results in reactive biasing forces on at least the first sloping portion of the spring clip member in a direction toward the dam member in order to frictionally engage and anchor the roofing material between the dam member and the spring clip member when the fascia member is securely installed on the assembly.

In one embodiment of the invention, a number of discrete spring clip members are interposed between the dam member and the fascia member at spaced apart locations along the roof edge assembly. In an alternate embodiment of the invention, however, a single spring clip member is substantially continuous and co-extensive with each generally straight run of the roof edge assembly along the edge of the building roof structure.

Additional objects, advantages, and features of the present invention will become apparent from the following description and appended claims, taken in conjunction with the accompanying drawings.

DETAILED DESCRIPTION OF THE PREFERRED EMBODIMENTS

Figure 1:
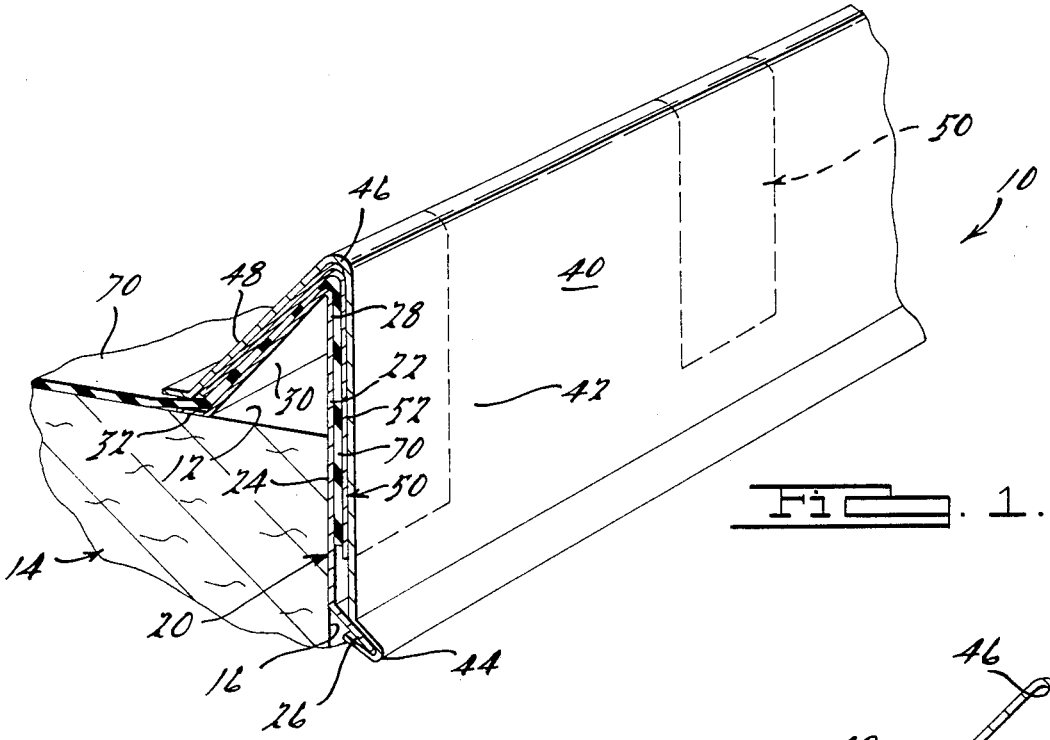
FIG. 1 is a perspective view of an exemplary raised roof edge assembly secured to the top edge of a building in accordance with the present invention.
Figure 2:
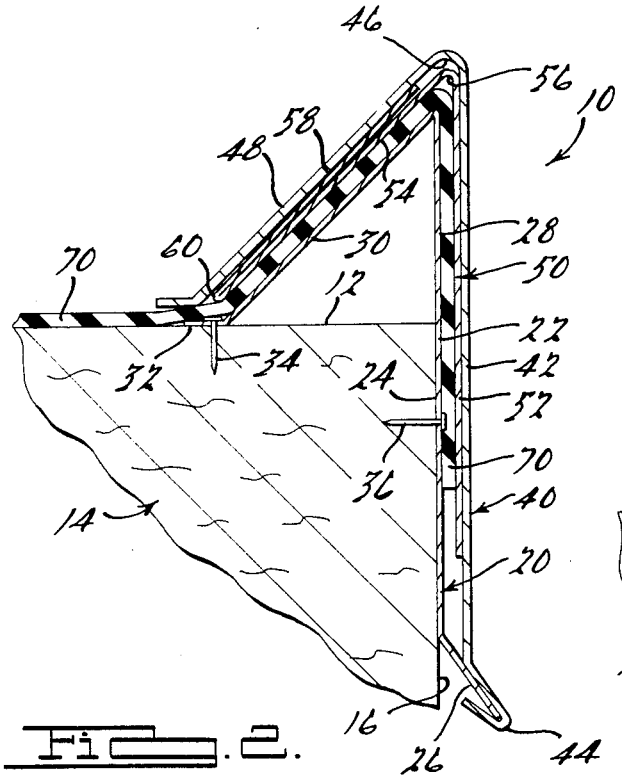
FIG. 2 is a cross-sectional view of the roof edge assembly of FIG. 1.
Figure 3:
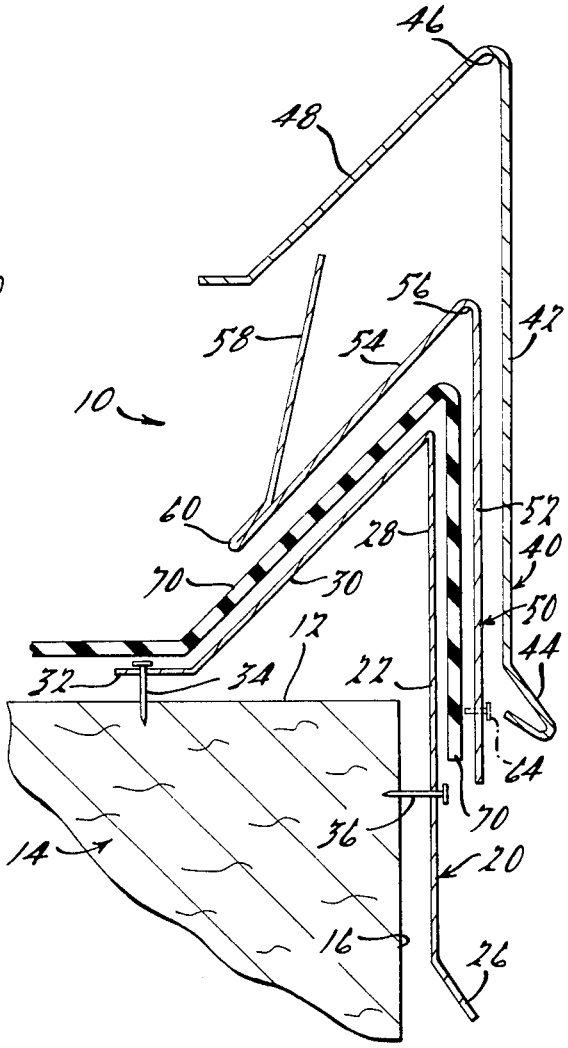
FIG. 3 is an exploded cross-sectional view of the roof edge assembly of FIGS. 1 and 2, illustrating the preferred spring clip member in its free, undeflected state.

FIGS. 1 through 8 illustrate various exemplary embodiments of an assembly for forming a raised roof edge on a building structure in accordance with the present invention. It should be noted, however, that the present invention is applicable in roof edge assemblies for building structures other than that shown for purposes of illustration in the drawings, as well as in other applications for forming building edge constructions.

In FIGS. 1 through 4, a preferred raised roof edge assembly 10 for forming a raised gravel stop and water dam on a roof 12 of a building structure 14 generally includes a dam member 20, a fascia member 40, and a spring clip member 50 interposed between the dam member 20 and the fascia member 40. Preferably, and perhaps more commonly in practice, the assembly also includes a portion of a roofing material 70 overlappingly engaging the dam member 20 and being grippingly interposed between the dam member 20 and the spring clip member 50.

The preferred dam member 20 includes a generally vertical dam portion 22 having an inwardly directed face 24 positionable in a generally confronting relationship with an outer face 16 of the building structure 14. The vertical dam portion 22 extends generally upwardly from a lower dam edge portion 26 to an upper dam portion 28 disposed above the roof 12 of the building structure 14 when the vertical dam portion 22 is positioned in a generally confronting relationship with the outer face 16. The dam member 20 preferably also includes a sloping dam portion 30 extending generally downwardly and inwardly from the top of the upper dam portion 28 to engage the roof 12 of the building structure 14. A flange 32, which is preferably provided at the lower edge of the sloping dam portion 30, is secured to the building structure by a roofing nail or other suitable fastener 34 for attaching the sloping dam portion 30 to the roof 12. Likewise, a similar fastener 36 is preferably provided for attaching the vertical dam portion 22 to the outer face 16 of the building structure 14. In order to securely and interlockingly install the fascia member 40 on the dam member 40 in a manner to be described below, the lower dam edge portion 26 can advantageously be bent or otherwise formed in a generally downwardly and outwardly extending direction.

The preferred fascia member 40 is formed of a sheet material, such as sheet metal for example, and includes a generally vertical fascia portion 42 extending between a lower channel portion 44 and a generally concave upper portion 46 formed at the intersection of the vertical fascia portion 42 and a sloping fascia portion 48 that extends in a generally downward and inward direction relative to the vertical fascia portion 42. As is illustrated in FIGS. 1 through 4, the concave upper portion 46 receives and overlappingly engages the sloping dam portion 30, and the lower channel portion 44 receives the lower dam edge portion 26 therein when the fascia member 40 is securingly and interlockingly installed on the dam member 20.

The separate spring clip member 50 is interposed between the fascia member 40 and the dam member 20 when the fascia member 40 is securely installed in place, and is preferably formed from a sheet-like spring material, such as spring steel sheet for example. The preferred spring clip member 50 has a generally vertical spring clip portion 52 positionable in a generally confronting relationship with the vertical dam portion 22. A first sloping portion 54 of the spring clip member extends in a generally downward and inward direction from the top of the upper dam portion 28 when the spring clip member is positioned on the dam member 20 and forms a generally concave upper spring clip portion 56 with the vertical spring clip portion 52. The preferred spring clip member 50 further includes a second sloping portion 58 extending in a generally upward and preferably outward direction from a lower spring clip edge portion 60 to form a generally acute angle with the first sloping portion 54. Although it is preferred that the entire spring clip member 50 is resiliently deflectable, at least the second sloping portion 58 is resiliently and pivotally deflectable relative to the lower spring clip portion 60 in a direction toward the first sloping portion 54 when the fascia member 40 is securely installed on the dam member 20 with the spring clip member 50 interposed therebetween. A fastener 64 can optionally be included in order to secure or attach the vertical spring clip portion 52 to the outer face 16 of the building structure 14, through the vertical dam portion 22. Such optional fastener 64 is discussed in more detail below, in connection with FIG. 8.

The roofing material 70 is preferably a flexible sheet-like material, which may be a resilient plastic, a resilient rubber or other elastomeric material, tar paper, roofing felt, or other suitable roofing materials known to those skilled in the art. The roofing material 70 flatly engages the upper surface of the roof 12 and includes a portion thereof interposed between at least the sloping dam portion 30 and the first sloping portion 54 of the spring clip member 50. Preferably, however, the roofing material 70 extends outwardly and then downwardly to also overlappingly engage the vertical dam portion 22 to be grippingly engaged between the vertical dam portion 22 and the vertical spring clip portion 52. As is described more fully below, the fascia member 40 is interlockingly and securely installed on the dam member 20, with the spring clip member 50 interposed therebetween, in order to frictionally anchor and secure the roofing material 70 between the spring clip member 50 and the dam member 20.

Figure 4:
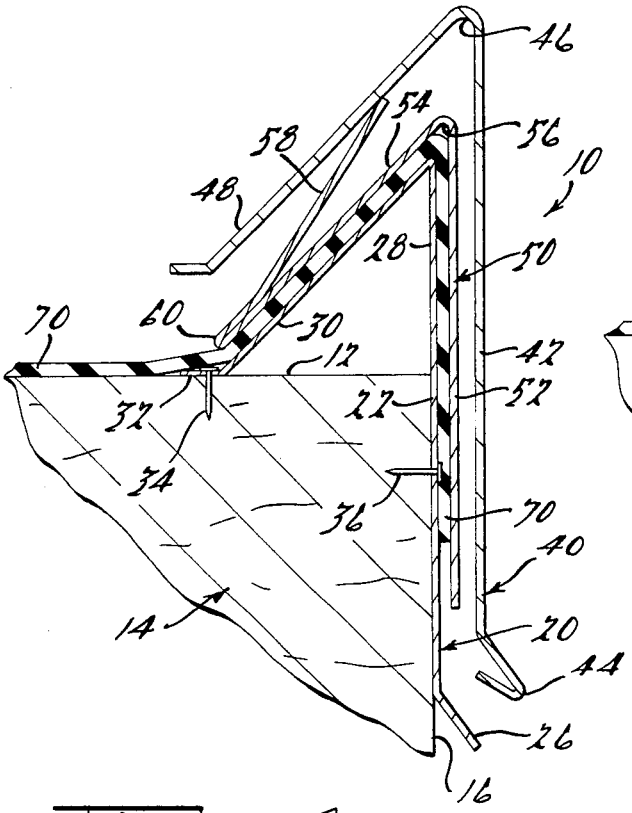
FIG. 4 is a cross-sectional view similar to FIG. 2, but illustrating the fascia member being installed on the remainder of the roof edge assembly.

FIG. 4 illustrates the manner in which the fascia member 40 is interlockingly installed on the remainder of the raised roof edge assembly 10. Once the dam member 20 is securingly attached to the building structure 14, and the roofing material 70 is properly positioned in an overlapping engagement on the dam member 20, the spring clip member 50 is positioned over the roofing material 70 and the dam member 20 and is optionally secured to the building structure 14 by the fastener 64. The concave upper portion 46 of the fascia member 40 is placed over the spring clip member 50 and urged downwardly so as to resiliently deflect or collapse at least the second sloping portion 58 of the spring clip member. Such deflection of the second sloping portion 58 allows the lower channel portion 44 of the fascia member 40 to clear the lower dam edge portion 26. Thereafter, the fascia member 40 is released and the resilient nature of the spring clip member 50 causes the fascia member 40 to spring or snap upwardly such that the lower channel portion 44 interlockingly receives the lower dam edge portion 26 and is captured thereon. In this manner, the fascia member 40 is resiliently and removably secured to the dam member 20 in a generally tight and rattle-free secure installation thereon. Such relatively tight installation of the fascia member 40 on the remainder of the raised roof edge assembly 10 results in a relatively tight frictional securement of the roofing material 70 between the spring clip member 50 and the dam member 20 as is described in more detail below.

As a result of its resilient deflection, the second sloping portion 58 of the spring clip member 50 exerts a resilient biasing force on the sloping fascia portion 48 and the concave upper portion 46 of the fascia member 40 in a generally upward and inward direction when the fascia member 40 is securely and interlockingly installed on the dam member 20 with the spring clip member 50 interposed therebetween. This resilient biasing force further results in a reactive force on the first sloping portion 54 of the spring clip member 50 in a generally downward and outward direction, biasing the first sloping portion 54 against the sloping dam portion 30 in order to frictionally anchor, compress and secure the roofing material 70 between the spring clip member 50 and the dam member 20 when the fascia member 40 is installed. Also, because of the resiliency of the spring clip member 50, the lower dam edge portion 26 preferably exerts a biasing force on the lower channel portion 44 of the fascia member 40 in a generally downward and inward direction when the fascia member 40 is installed. In addition to the above, the above mentioned biasing forces on the concave upper portion 46 and on the lower portion 44 of the fascia member 40 result in a generally inwardly-directed force being exerted on the vertical fascia portion 42 when the fascia member 40 is installed. Preferably, such inwardly-directed force on the vertical fascia portion 42 forcibly biases the vertical spring clip portion 52 in an inward direction in order to frictionally anchor, compress and secure the roofing material 70 between the vertical spring clip portion 52 and the vertical dam portion 22. Therefore, as can readily be appreciated from the above discussion and the drawings, the interposition of the spring clip member 50 between the fascia member 40 and the dam member 20 provides a very positive and secure anchoring of the roofing material 70 between the spring clip member 50 and the dam member 20, as well as providing for a relatively tight, rattle-free and secure installation of the fascia member 40 on the remainder of the raised roof edge assembly 10.

Figure 5:
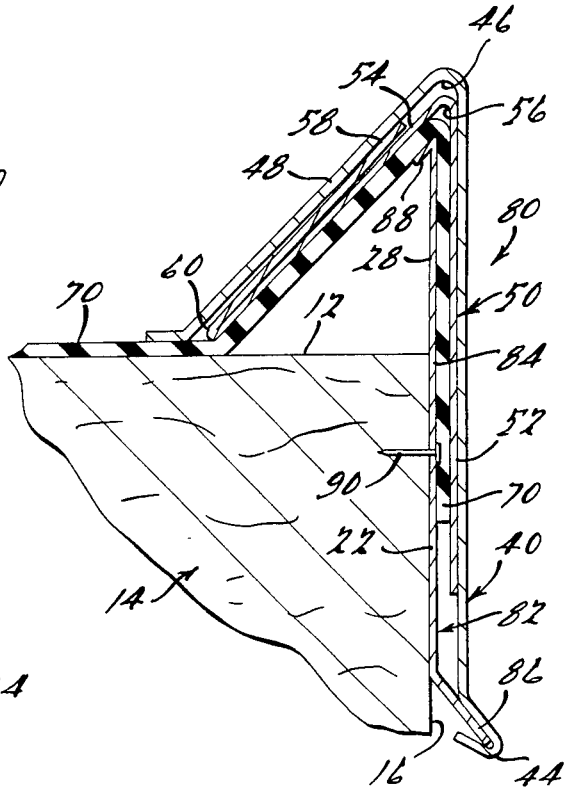
FIG. 5 is a cross-sectional view similar to that of FIG. 2, but illustrating another embodiment of the roof edge assembly according to the present invention.

FIG. 5 illustrates an alternate embodiment of the invention, wherein a raised roof edge assembly 80 is generally similar to the raised roof edge assembly 10 shown in FIGS. 1 through 4, with the exception of the provision of an alternate dam member 82. Since the remaining components of the alternate raised roof edge assembly 80 are substantially similar to the corresponding components of the raised roof edge assembly 10, the same reference numerals are used to indicate such similar corresponding components in the roof edge assembly 10 and in the roof edge assembly 80.

The alternate dam member 82 shown in FIG. 5 is somewhat similar to the dam member 20 shown in FIGS. 1 through 4, except that the vertical dam portion 84 extends from a lower dam edge portion 86 to a preferably bent-over lip portion 88 located above the roof 12, generally at the top of the vertical dam portion 84. One or more fasteners 90 are used to secure the vertical dam portion 84 to the outer face 16 of the building structure 14. When the spring clip member 50 and the fascia member 40 are installed on the dam member 82, with the roofing material 70 interposed between the spring clip member 50 and the dam member 82, the lower spring clip edge portion 60 holds the roofing material 70 against the roof 12 in a manner similar to that in which the lower spring clip edge portion 60 holds the roofing material 70 against the dam member 20 and the roof 12 in the above-described raised roof edge assembly 10. Furthermore, the interlocking installation of the fascia member 40 on the remainder of the alternate raised roof edge assembly 80 also causes the spring clip member 50 to resiliently bias the roofing material 70 against the roof 12 and the vertical dam portion 84 by way of reactive forces generally similar to those discussed above in connection with the raised roof edge assembly 10.

Figure 6:
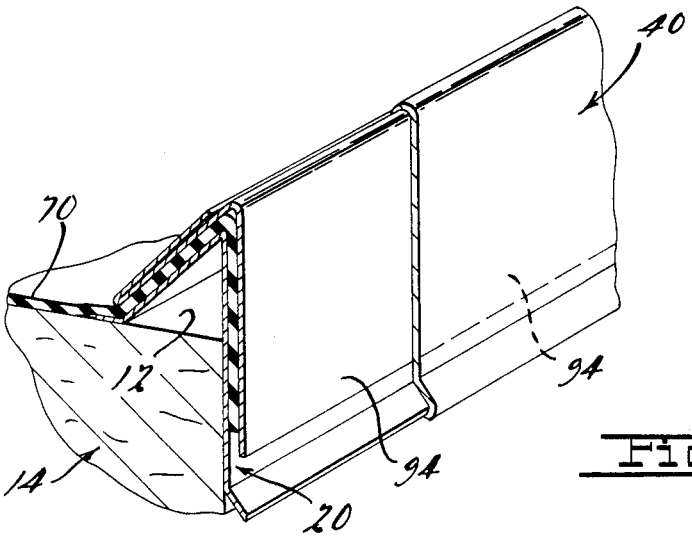
FIG. 6 is a perspective view similar to that of FIG. 1, but illustrating a further embodiment of the present invention having a generally continuous spring clip member.

Although a number of spring clip members 50 are provided at predetermined spaced-apart locations along the raised roof edge assembly 10 shown in FIG. 1, an alternate configuration of the alternate spring clip member 94 shown in FIG. 6 can also be provided. Such alternate spring clip member 94 can have the same cross-sectional configuration as spring clip member 50, or even the alternate cross-sectional configuration shown in FIG. 7 discussed below, and is generally continuous and co-extensive with generally straight portions of either the raised roof edge assembly 10 or the alternate raised roof edge assembly 80, in lieu of the discrete, spaced-apart spring clip members 50 shown in FIG. 1.

Figure 7:
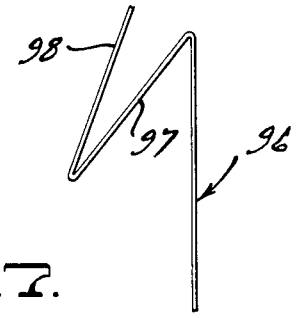
FIG. 7 is a cross-sectional view of still another embodiment of the spring clip member according to the present invention.

FIG. 7 illustrates still another alternate spring clip member 96, which can be employed with any of the embodiments of the invention described herein. The alternate spring clip member 96 has a first sloping portion 97 and a second sloping portion 98 that intersect at their respective lower edges to form a generally acute angle therebetween. Such a configuration eliminates the flattened configuration of the lower spring clip edge portion 60 of the spring clip members 50 and 94. The configuration of the alternate spring clip member 96, which can be advantageously employed where the spring clip member is formed of a particularly thick material or other material that presents difficulties in forming by bending, functions in a manner similar to that described above to frictionally and grippingly anchor, compress and secure the roofing material 70.

Figure 8:
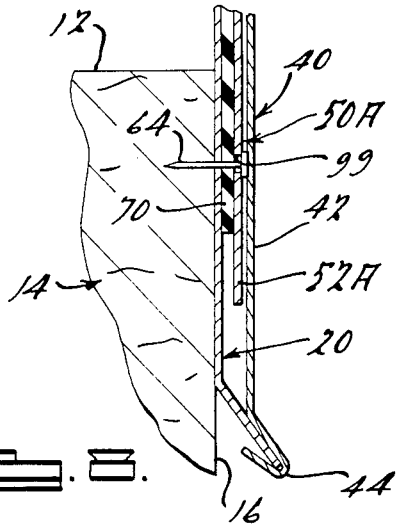
FIG. 8 is a partial cross-sectional view of still another optional construction of the spring clip member according to the present invention.

FIG. 8 illustrates another optional construction according to the present invention in an alternate spring clip member 50A. It should be noted that the construction shown in FIG. 8 can optionally be employed in any or all of the other embodiments of the invention shown in FIGS. 1 through 7 and discussed above.

The optional alternate spring clip member 50A has an aperture 99 extending through its vertical spring clip portion 52A for receiving the optional fastener 64 extending therethrough, as well as through the roofing material 70 and into the outer face 16 of the building structure 14. In this construction, the roofing material 70 is anchored to the outer face 16 both by the frictional and gripping engagement of the spring clip 50A and the fascia member 42 and by the fastener 64 in applications wherein it is desirable to even more securely anchor the roofing material 70 to the building structure. Furthermore, in this arrangement, the spring clip functions as a washer-like bearing member in order to securely grip and engage the roofing material 70 and substantially prevent it from tearing in the area adjacent the point of penetration by the fastener 64. It should be noted that the opening 99 can be a hole or aperture of virtually any desired shape, including an elongated slot-like opening to provide some degree of flexibility in the position of the fastener 64. In addition, it should be noted that the optional fastener 64 can be used either in conjunction with, or instead of, the above-described fastener 36.

The foregoing discussion discloses and describes exemplary embodiments of the present invention. One skilled in the art will readily recognize from such discussion that various changes, modifications, and variations may be made therein without departing from the spirit and scope of the invention as defined in the following claims.

We claim:

1. An assembly for forming a raised roof edge on a building structure having a generally horizontal roof and a generally vertical outer face, said assembly comprising:

a dam member having a generally vertical dam portion with an inwardly directed face for confronting the outer face of the building structure, said generally vertical dam portion further having an upper dam portion and a lower dam edge portion, said dam member including a sloping dam portion extending generally downwardly and inwardly generally from said upper dam portion, and attachment means for attaching said generally vertical dam portion to the outer face of the building structure with said upper dam portion protruding upwardly above the roof of the building structure;

a fascia member installable on said dam member and having a generally concave upper portion for receiving said upper dam portion therein and a lower channel portion for receiving said lower dam edge portion therein when said fascia member is installed on said dam member; and a spring clip member for interposition between said fascia member and said dam member when said fascia member is installed thereon, said spring clip member having a generally vertical spring clip portion positionable in a generally confronting relationship with said generally vertical dam portion, a first sloping portion extending generally downwardly and inwardly generally from said vertical spring clip portion when said spring clip member is positioned on said dam member, said spring clip member further having a lower spring clip edge portion on said first sloping portion, and a second sloping portion extending generally upwardly generally from said lower spring clip edge portion, at least said second sloping portion being resiliently deflectable generally downwardly and outwardly toward said first sloping portion when said fascia member is installed on said dam member with said spring clip member interposed therebetween said first sloping portion of said spring clip member confronting said sloping dam portion when said spring clip member is interposed between said fascia member and said dam member and said fascia member is installed on said dam member.

2. An assembly for forming a raised roof edge on a building structure having a generally horizontal roof and a generally vertical outer face, said assembly comprising:

a dam member having a generally vertical dam portion with an inwardly directed face for confronting the outer face of the building structure, said generally vertical dam portion further having an upper dam portion and a lower dam edge portion, said dam member including a sloping dam portion extending generally downwardly and inwardly generally from the top of said upper dam portion, and attachment means for attaching said generally vertical dam portion to the outer face of the building structure with said upper dam portion protruding upwardly above the roof of the building structure;

a fascia member installable on said dam member and having a generally concave upper portion for receiving said upper dam portion therein and a lower channel portion for receiving said lower dam edge portion therein when said fascia member is installed on said dam member; and a spring clip member for interposition between said fascia member and said dam member when said fascia member is installed thereon, said spring clip member having a generally vertical spring clip portion positionable in a generally confronting relationship with said generally vertical dam portion, a first sloping portion extending generally downwardly and inwardly generally from the top of said vertical spring clip portion when said spring clip member is positioned on said dam member, said spring clip member further having a lower spring clip edge portion on said first sloping portion, and a second sloping portion extending generally upwardly generally from said lower spring clip edge portion, at least said second sloping portion being resiliently deflectable generally downwardly and outwardly toward said first sloping portion when said fascia member is installed on said dam member with said spring clip member interposed therebetween, said first sloping portion of said spring clip member confronting said sloping dam portion when said spring clip member is interposed between said fascia member and said dam member.

3. An assembly according to claim 2, further comprising attachment means for attaching said sloping dam portion to the roof of the building structure generally at a lower edge portion of said sloping dam portion.

4. An assembly according to claim 1, further comprising roofing material overlappingly engaging said dam member and being anchored between said spring clip member and said dam member at least when said fascia member is installed on said dam member with said spring clip member interposed therebetween.

5. An assembly according to claim 4, wherein said roofing material overlappingly engages said upper dam portion and said vertical dam portion.

6. An assembly according to claim 1, wherein said dam member and said fascia member are generally horizontally elongated for generally horizontal installation along the roof edge, said assembly including a number of said spring clip members interposed between said dam member and said fascia member at predetermined horizontally spaced apart locations.

7. An assembly according to claim 1, wherein said dam member and said fascia member are generally horizontally elongated for generally horizontal installation along the roof edge, said spring clip member also being generally horizontally elongated and generally horizontally continuous with said dam member and fascia member.

8. An assembly for forming a raised roof edge on a building structure having a generally horizontal roof and a generally vertical outer face, said assembly comprising:

a dam member having a generally vertical dam portion with an inwardly directed face for confronting the outer face of the building structure, said generally vertical dam portion further having an upper dam portion and a lower dam edge portion, and attachment means for attaching said generally vertical dam portion to the outer face of the building structure with said upper dam portion protruding upwardly above the roof of the building structure;

a fascia member installable on said dam member and having a generally concave upper portion for receiving said upper dam portion therein and a lower channel portion for receiving said lower dam edge portion therein when said fascia member is installed on said dam member;

a spring clip member for interposition between said fascia member and said dam member when said fascia member is installed thereon, said spring clip member having a generally vertical spring clip portion positionable in a generally confronting relationship with said generally vertical dam portion, a first sloping portion extending generally downwardly and inwardly generally from the top of said vertical spring clip portion when said spring clip member is positioned on said dam member, said spring clip member further having a lower spring clip edge portion on said first sloping portion, and a second sloping portion extending generally upwardly generally from sasid lower spring clip edge portion, at least said second sloping portion being resiliently deflectable generally downwardly and outwardly toward said first sloping portion when said fascia member is installed on said dam member with said spring clip member interposed therebetween;

roofing material overlapping engaging said upper dam portion and said vertical dam portion of said dam member and being anchored between said spring clip member and said dam member at least when said fascia member is installed on said dam member with said spring clip member interposed therebetween; and attachment means for attaching said generally vertical spring clip portion to the outer face of the building structure with said vertical dam portion therebetween, said attachment means extending through an opening in said vertical spring clip portion, through said roofing material and said vertical dam portion, and into said building structure, said vertical spring clip portion acting as a washer-like structure to substantially prevent tearing of said roofing material adjacent said attachment means.

9. An assembly according to claim 6, wherein said opening in said vertical spring clip portion is an elongated opening.

10. An assembly for forming a raised roof edge on a building structure having a generally horizontal roof and a generally vertical outer face, said assembly comprising:

a dam member having a generally vertical dam portion with an inwardly directed face for confronting the outer face of the building structure, said generally vertical dam portion further having an upper dam portion and a lower dam edge portion, and attachment means for attaching said generally vertical dam portion to the outer face of the building structure with said upper dam portion protruding upwardly above the roof of the building structure;

a fasica member installable on said dam member and having a generally concave upper portion for receiving said upper dam portion therein and a lower channel portion for receiving said lower dam edge portion therein when said fascia member is installed on said dam member;

a spring clip member for interposition between said fascia member and said dam member when said fascia member is installed thereon, said spring clip member having a generally vertical spring clip portion positionable in a generally confronting relationship with said generally vertical dam portion, a first sloping portion extending generally downwardly and inwardly generally from the top of said vertical spring clip portion when said spring clip member is positioned on said dam member, said spring clip member further having a lower spring clip edge portion on said first sloping portion, and a second sloping portion extending generally upwardly generally from said lower spring clip edge portion, at least said second sloping portion being resiliently deflectable generally downwardly and outwardly toward said first sloping portion when said fascia member is installed on said dam member with said spring clip member interposed therebetween; and attachment means for attaching said generally vertical spring clip portion to the outer face of the building structure with said vertical dam portion therebetween.

11. An assembly for forming a raised roof edge on a building structure having a generally horizontal roof and a generally vertical outer face, said assembly comprising:

a dam member having a generally vertical dam portion with an inwardly directed face positionable in a generally confronting relationship with the outer face of the building structure, said vertical dam portion extending generally upwardly from a lower dam edge portion to an upper dam portion above the roof of the building structure when said vertical dam portion is positioned in said confronting relationship with the outer face of the building structure, said dam member further including a sloping dam portion extending generally downwardly and inwardly from said upper dam portion to engage the roof of the building structure, and attachment means for attaching said generally vertical dam portion to the outer face of the building structure;

a fascia member securingly installable on said dam member and having a concave upper portion for receiving said upper dam portion therein in an overlapping engagment with said sloping dam portion, and a lower channel portion for receiving said lower dam edge portion therein when said fascia member is securingly installed on said dam member; and a separate spring clip member for interposition between said fascia member and said dam member when said fascia member is securingly installed thereon, said spring clip member having a generally vertical spring clip portion positionable in a confronting relationship with said generally vertical dam portion, and a first sloping portion extending generally downwardly and inwardly from said upper dam portion and confronting said sloping dam portion when said spring clip member is positioned on said dam member, said spring clip member further having a lower spring clip edge portion on said first sloping portion, and a second sloping portion extending generally upwardly and outwardly generally from said lower spring clip edge portion in order to form an acute angle with said first sloping portion, at least said second sloping portion being resiliently and pivotally deflectable relative to said lower spring clip portion generally toward said first sloping portion when said fascia member is securingly installed on said dam member with said spring clip member interposted therebetween.

12. An assembly according to claim 11, further comprising attachment means for attaching said sloping dam portion to the roof of the building structure generally at the area of said engagement of said sloping dam portion with the roof.

13. An assembly according to claim 11, further comprising sheet like roofing material overlappingly engaging at least said sloping dam portion and being anchored between said spring clip member and said dam member at least when said fascia member is securingly installed on said dam member with said spring clip member interposed therebetween.

14. An assembly according to claim 13, wherein said roofing material overlappingly engages both said sloping dam portion and said vertical dam portion.

15. An assembly according to claim 11, wherein said dam member and said fascia member are generally horizontally elongated for generally horizontal installation along the roof edge, said assembly including a number of said spring clip members interposed between said dam member and said fascia member at predetermined spaced apart locations.

16. An assembly according to claim 11, wherein said dam member and said fascia member are generally horizontally elongated for generally horizontal installation along the roof edge, said spring clip member also being generally horizontally elongated and generally horizontally continuous with said dam member and said fascia member.

17. An assembly according to claim 11, wherein said lower dam edge portion includes a flange portion extending generally downwardly and outwardly relative to said vertical dam portion, said flange portion being received in said lower channel portion of said fascia member when said fascia member is securingly installed on said dam member.

18. An assembly according to claim 11, wherein said second sloping portion of said spring clip member exerts a resilient biasing force on said concave upper portion of said fascia member in a generally upward and inward direction when said fascia member is securingly installed on said dam member with said spring clip member interposed therebetween, said resilent biasing force resulting in a reactive force on said first sloping portion in a generally downward and outward direction biasing said first sloping portion against said sloping dam portion.

19. An assembly according to claim 18, further comprising a sheet-like roofing material overlappingly engaging at least said sloping dam portion and being interposed between said sloping dam portion and first sloping portion of said spring clip member, said reactive force on said first sloping portion anchoring said roofing material between said spring clip member and said dam member when said fascia member is securingly installed on said dam member with said spring clip member interposed therebetween.

20. An assembly according to claim 19, wherein said lower dam edge portion exerts a biasing force on said lower channel portion of said fascia member in a generally downward and inward direction when said fascia member is securingly installed on said dam member with said spring clip member interposed therebetween.

21. An assembly according to claim 20, further comprising sheet-like roofing material overlappingly engaging both said sloping dam portion and said vertical dam portion and further being interposed between said vertical dam portion and said vertical spring clip portion, said fascia member further including a generally vertical fascia portion between said concave upper portion and said lower channel portion, said biasing forces on said concave upper portion and on said lower channel portion of said fascia member resulting in a generally inward force on said vertical fascia portion when said fascia member is securingly installed on said dam member with said spring clip interposed therebetween, said generally inward force on said vertical fascia portion also forcibly biasing said vertical spring clip portion generally inwardly in order to anchor said roofing material between said vertical spring clip portion and said vertical dam portion.

22. An assembly for forming a raised roof edge on a building structure having a generally horizontal roof and a generally vertical outer face, said assembly comprising:

a dam member having a generally vertical dam portion with an inwardly directed face positionable in a generally confronting relationship with the outer face of the building structure, said vertical dam portion extending generally upwardly from a lower dam edge portion to an upper dam portion above the roof of the building structure when said vertical dam portion is positioned in said confronting relationship with the outer face of the building structure, said dam member further including a sloping dam portion extending generally downwardly and inwardly from the top of said upper dam portion to engage the roof of the building structure, and attachment means for attaching said generally vertical dam portion to the outer face of the building structure;

a fascia member securingly installable on said dam member and having a concave upper portion for receiving said upper dam portion therein in an overlapping engagement with said sloping dam portion, and a lower channel portion for receiving said lower dam edge portion therein when said fascia member is securingly installed on said dam member;

a separate spring clip member for interposition between said fascia member and said dam member when said fascia member is securingly installed thereon, said spring clip member having a generally vertical spring clip portion positionable in a confronting relationship with said generally vertical dam portion, and a first sloping portion extending generally downwardly and inwardly from the top of said upper dam portion when said spring clip member is positioned on said dam member, said spring clip member further having a lower spring clip edge portion on said first sloping portion, and a second sloping portion extending generally upwardly and outwardly generally from said lower spring clip edge portion in order to form an acute angle with said first sloping portion, at least said second sloping portion being resiliently and pivotally deflectable relative to said lower spring clip portion generally toward said first sloping portion when said fascia member is securingly installed on said dam member with said spring clip member interposed therebetween;

sheet like roofing material overlappingly engaging at least said sloping dam portion and said vertical dam portion of said sloping dam portion and being anchored between said spring clip member and said dam member at least when said fascia member is securingly installed on said dam member with said spring clip member interposed therebetween; and attachment means for attaching said generally vertical spring clip portion to the outer face of the building structure with said vertical dam portion therebetween, said attachment means extending through an opening in said vertical spring clip portion, through said roofing material and said vertical dam portion, and into said building structure, said vertical spring clip portion acting as a washer-like structure to substantially prevent tearing of said roofing material adjacent said attachment means.

23. An assembly according to claim 22, used wherein said opening in said vertical spring clip portion is an elongated opening.

24. An assembly for forming a raised roof edge on a building structure having a generally horizontal roof and a generally vertical outer face, said assembly comprising:

a dam member having a generally vertical dam portion with an inwardly directed face positionable in a generally confronting relationship with the outer face of the building structure, said vertical dam portion extending generally upwardly from a lower dam edge portion to an upper dam portion above the roof of the building structure when said vertical dam portion is positioned in said confronting relationshp with the outer roof of the building structure, said dam member further including a sloping dam portion extending generally downwardly and inwardly from said upper dam portion to engage the roof of the building structure, and attachment means for attaching said generally vertical dam portion to the outer face of the building structure;

a fascia member securingly installable on said dam member and having a concave upper portion for receiving said upper dam portion therein in an overlapping engagement with said sloping dam portion, and a lower channel portion for receiving said lower dam edge portion therein when said fascia member is securingly installed on said dam member;

a separate spring clip member for interposition between said fascia member and said dam member when said fascia member is securingly installed thereon, said spring clip member being composed of a spring material and having a generally vertical spring clip portion positioinable in a confronting relationship with said generally vertical dam portion, and a first sloping portion extending generally downwardly and inwardly from said upper dam portion and confronting said sloping dam portion when said spring clip member is positioned on said dam member, said spring clip member further having a lower spring clip edge portion on said first sloping portion, and a second sloping portion extending generally upwardly and outwardly generally from said lower spring clip edge portion in order to form an acute angle with said first sloping portion, at least said second sloping portion being resiliently and pivotally deflectable relative to said lower spring clip portion generally toward said first sloping portion when said fascia member is securingly installed on said dam member with said spring clip member interposed therebetween; and sheet-like roofing material overlappingly engaging at least said sloping dam portion and being interposed between said sloping dam portion and said first sloping portion of said spring clip member, said resilient deflection of said second sloping portion toward said first sloping portion of said spring clip member resulting in a reactive force biasing said first sloping portion toward said sloping dam portion when said fascia member is securingly installed on said dam member with said spring clip member interposed therebetween in order to anchor said roofing material between said sloping dam portion and said first sloping portion of said spring clip member.

25. An assembly according to claim 24, wherein said roofing material overlappingly engages both said sloping dam portion and said vertical dam portion and is interposed between said vertical dam portion and said vertical spring clip portion, said resilient deflection of said second sloping portion toward said first sloping portion of said spring clip member resulting in a generally inwardly directed reactive force on said fascia member and on said vertical spring clip portion when said fascia member is securingly installed on said dam member with said spring clip interposed therebetween in order to further anchor said roofing material between said vertical spring clip portion and said vertical dam portion.

26. An assembly according to claim 24, wherein said dam member and said fascia member are generally horizontally elongated for generally horizontal installation along the roof edge, said assembly including a number of said spring clip members interposed between said dam member and said fascia member at predetermined horizontally spaced apart locations.

27. An assembly according to claim 24, wherein said dam member and said fascia member are generally horizontally elongated for generally horizontal installation along the roof edge, said spring clip member also being generally horizontally elongated and generally horizontally continuous with said dam member and said fascia member.

28. An assembly according to claim 24, wherein said lower dam edge portion includes a flange portion extending generally downwardly and outwardly relative to said vertical dam portion, said flange portion being received in said lower channel portion of said fascia member when said fascia member is securingly installed on said dam member.

29. An assembly according to claim 24, further comprising attachment means for attaching said sloping dam portion to the roof of the building structure generally at the area of said engagement of said sloping dam portion with the roof.

30. An assembly according to claim 24, wherein said second sloping portion of said spring clip member exerts a resilient biasing force on said concave upper portion of said fascia member in a generally upward and inward direction when said fascia member is securingly installed on said dam member with said spring clip member interposed therebetween, said resilient biasing force resulting in a reactive force on said first sloping portion in a generally downward and outward direction biasing said first sloping portion against said sloping dam portion.

31. An assembly according to claim 30, wherein said lower dam edge portion exerts a biasing force on said lower channel portion of said fascia member in a generally downward and inward direction when said fascia member is securingly installed on said dam member with said spring clip member interposed therebetween.

32. An assembly according to claim 31, wherein said dam member and said fascia member are generally horizontally elongated for generally horizontal installation along the roof edge, said assembly including a number of said spring clip members interposed between said dam member and said fascia member at predetermined horizontally spaced apart locations.

33. An assembly according to claim 31, wherein said dam member and said fascia member are generally horizontally elongated for generally horizontal installation along the roof edge, said spring clip member also being generally horizontally elongated and generally horizontally continuous with said dam member and said fascia member.

34. An assembly for forming a raised roof edge on a building structure having a generally horizontal roof and a generally vertical outer face, said assembly comprising:

a dam member having a generally vertical dam portion with an inwardly directed face positionable in a generally confronting relatioship with the outer face of the building structure, said vertical dam portion extending generally upwardly from a lower dam edge portion to an upper dam portion above the roof of the building structure when said vertical dam portion is positioned in said confronting relationship with the outer face of the building structure, said dam member further including a sloping dam portion extending generally downwardly and inwardly from the top of said upper dam portion to engage the roof of the building structure, and attachment means for attaching said generally vertical dam portion to the outer face of the building structure;

a fascia member securingly installable on said dam member and having a concave upper portion for receiving said upper dam portion therein in an overlapping engagement with said sloping dam portion, and a lower channel portion for receiving said lower dam edge portion therein when said fascia member is securingly installed on said dam member;

a separate spring clip member for interposition between said fascia member and said dam member when said fascia member is securingly installed thereon, said spring clip member being composed of a spring material and having a generally vertical spring clip portion positionable in a confronting relatioship with said generally vertical dam portion, and a first sloping portion extending generally downwardly and inwardly from the top of said upper dam portion when said spring clip member is positioned on said dam member, said spring clip member further having a lower spring clip edge portion on said first sloping portion, and second sloping portion extending generally upwardly and outwardly generally from said lower spring clip edge portion in order to form an acute angle with said first sloping portion, at least said second sloping portion being resiliently and pivotally deflectable relative to said lower spring clip portion generally toward said first sloping portion when said fascia member is securingly installed on said dam member with said spring clip member interposed therebetween;

sheet-like roofing material overlappingly engaging at least said sloping dam portion and being interposed between said sloping dam portion and said first sloping portion of said spring clip member, said resilient deflection of said second sloping portion toward said first sloping portion of said spring clip member resulting in a reactive force biasing said first sloping portion toward said sloping dam portion when said fascia member is securingly installed on said dam member with said spring clip member interposed therebetween in order to anchor said roofing material between said sloping dam portion and said first sloping portion of said spring clip member, said roofing material further overlappingly engaging both said sloping dam portion and said vertical dam portion and being interposed between said vertical dam portion and said vertical spring clip portion, said resilient deflection of said second sloping portion toward said first sloping portion of said spring clip member resulting in a generally inwardly directed reactive force on said fascia member and on said vertical spring clip portion when said fascia member is securingly installed on said dam member with said spring clip interposed therebetween in order to further anchor said roofing material between said vertical spring clip portion and said vertical dam portion; and attachment means for attaching said generally vertical spring clip portion to the outer face of the building structure with said vertical dam portion therebetween, said attachment means extending through an opening in said vertical spring clip portion, through said roofing material and said vertical dam portion, and into said building structure, said vertical spring clip portion acting as a washer-like structure to substantially prevent tearing of said roofing material adjacent said attachment means.

35. An assembly according to claim 34, wherein said opening in said spring clip portion is an elongated opening.

36. An assembly for forming a raised roof edge on a building structure having a generally horizontal roof and a generally vertical outer face, said assembly comprising:

a dam member having a generally vertical dam portion with an inwardly directed face positionable in a generally confronting relationship with the outer face of the building structure, said vertical dam portion extending generally upwardly from a lower dam edge portion to an upper dam portion above the roof of the building structure when said vertical dam portion is positioned in said confronting relationship with the outer face of the building structure, said dam member further including a sloping dam portion extending generally downwardly and inwardly from the top of said upper dam portion to engage the roof of the building structure, and attachment means for attaching said generally vertical dam portion to the outer face of the building structure;

a fascia member securingly installable on said dam member and having a concave upper portion for receiving said upper dam portion therein in a overlapping engagement with said sloping dam portion, and a lower channel portion for receiving said lower dam edge portion therein when said fascia member is securingly installed on said dam member;

a separate spring clip member for interposition between said fascia member and said dam member when said fascia member is securingly installed thereon, said spring clip member being composed of a spring material and having a generally vertical spring clip portion positionable in a confronting relationship with said generally vertical dam portion, and a first sloping portion extending generally downwardly and inwardly from the top of said upper dam portion when said spring clip member is positioned on said dam member, said spring clip member further having a lower spring clip edge portion on said first sloping portion, and a second sloping portion extending generally upwardly and outwardly generally from said lower spring clip edge portion in order to form an acute angle with said first sloping portion, at least said second sloping portion being resiliently and pivotally deflectable relative to said lower spring clip portion generally toward said first sloping portion when said fascia member is securingly installed on said dam member with said spring clip member interposed therebetween;

sheet-like roofing material overlappingly engaging at least said sloping dam portion and being interposed between said sloping dam portion and said first sloping portion of said spring clip member, said resilient deflection of said second sloping portion toward said first sloping portion of said spring clip member resulting in a reactive force biasing said first sloping portion toward said sloping dam portion when said fascia member is securingly installed on said dam member with said spring clip member interposed therebetween in order to anchor said roofing material between said sloping dam portion and said first sloping portion of said spring clip member;

attachment means for attaching said sloping dam portion to the roof of the building structure generally at the area of said engagement of said sloping dam portion with the roof; and attachment means for attaching said vertical spring clip portion to the outer face of the building structure.

* * * * *

UNITED STATES PATENT AND TRADEMARK OFFICE

CERTIFICATE OF CORRECTION

PATENT NO. : 4,641,476

DATED : February 10, 1987

INVENTOR(S) : Russell Webb, et al

It is certified that error appears in the above-identified patent and that said Letters Patent is hereby corrected as shown below:

On the title page
Under Foreign Patent Documents, Item 13, "of 1911" should be -- 3/1911 --.

| | | |
|---|---|---|
| Column 9, | line 20, | "sasid" should be -- said --. |
| Column 9, | line 27, | "overlapping" should be -- overlappingly --. |
| Column 9, | line 44, | "claim 6" should be -- claim 8 --. |
| Column 11, | line 3, | "interposted" should be -- interposed --. * |
| Column 13, | line 18, | "used" should be deleted. |
| Column 13, | line 33, | "relationshp" should be -- relationship --. |
| Column 13, | line 33, | "roof" should be -- face --. |
| Column 13, | line 54, | "positioinable" should be -- positionable --. |
| Column 15, | line 27, | "relatioship" should be -- relationship --. |

UNITED STATES PATENT AND TRADEMARK OFFICE

CERTIFICATE OF CORRECTION

PATENT NO. : 4,641,476

DATED : February 10, 1987

INVENTOR(S) : Russell Webb et al

It is certified that error appears in the above-identified patent and that said Letters Patent is hereby corrected as shown below:

| | | |
|---|---|---|
| Column 15, | line 55, | "relatioship" should be -- relationship --. |
| Column 15, | line 61, | "and" should be -- and a --. |
| Column 16, | line 42, | "spring" should be -- vertical spring --. |

Signed and Sealed this

Twenty-fourth Day of November, 1987

*Attest:*

DONALD J. QUIGG

*Attesting Officer*

*Commissioner of Patents and Trademarks*